US005405649A

United States Patent [19]

Voit

[11] Patent Number: 5,405,649

[45] Date of Patent: Apr. 11, 1995

[54] APPARATUS FOR AND METHOD OF GLAZING ARTICLES OF EARTHENWARE OR PROCELAIN

[75] Inventor: Karl Voit, Weissenstadt, Germany

[73] Assignee: Michael Voit GmbH, Germany

[21] Appl. No.: 92,751

[22] Filed: Jul. 16, 1993

Related U.S. Application Data

[63] Continuation of Ser. No. 800,623, Nov. 27, 1991, abandoned.

[30] Foreign Application Priority Data

Dec. 5, 1990 [DE] Germany ..... 40 38 797.6

[51] Int. Cl.[6] ..... B05D 5/00

[52] U.S. Cl. ..... 427/226; 118/696; 118/416; 118/423; 118/425; 427/231; 427/232; 427/235; 427/443.2

[58] Field of Search ..... 118/696, 697, 416, 423, 118/425; 427/235, 231, 232, 443.2, 226

[56] References Cited

U.S. PATENT DOCUMENTS

| | | | |
|---|---|---|---|
| 1,404,309 | 1/1922 | McDonald | 118/416 |
| 1,711,643 | 5/1929 | Marshall | 118/416 |
| 2,195,670 | 4/1940 | Ferngren | 118/416 |
| 2,195,671 | 4/1940 | Ferngren | 427/443.2 |
| 2,755,205 | 7/1956 | Robb et al. | 118/423 |
| 2,824,029 | 2/1958 | Zinty | 118/53 |
| 2,845,045 | 7/1958 | Weiskopf | 118/425 |
| 3,429,358 | 2/1969 | Tingquist et al. | 118/416 |
| 3,530,825 | 9/1970 | Antonissen | 118/425 |
| 4,295,444 | 10/1981 | Hatta et al. | 118/416 |
| 4,314,524 | 2/1982 | Deguchi | 118/416 |
| 4,543,277 | 9/1985 | Giles | 118/416 |
| 4,659,445 | 4/1987 | Bogdan et al. | 427/235 |
| 4,915,986 | 4/1990 | Elias et al. | 118/425 |
| 4,995,331 | 2/1991 | Voit | 118/423 |

FOREIGN PATENT DOCUMENTS

| | | | |
|---|---|---|---|
| 3739602A1 | 6/1989 | Germany . | |
| 2005567 | 4/1979 | United Kingdom . | |
| 2061135 | 5/1981 | United Kingdom | 118/425 |
| 615151 | 6/1978 | U.S.S.R. | 118/416 |
| 0747907 | 7/1980 | U.S.S.R. | 118/696 |
| 0882700 | 11/1981 | U.S.S.R. | 118/425 |

*Primary Examiner*—W. Gary Jones
*Assistant Examiner*—Laura E. Edwards
*Attorney, Agent, or Firm*—Henry M. Feiereisen

[57] ABSTRACT

An apparatus for glazing hollow articles of earthenware or porcelain includes a glazing station with a glaze vessel by which the article is securely held in position and which is rotatable about its axis and tiltable from an initial position about an angle of 180°. In order to effectively glaze articles of bulged configuration and great depth and to allow excess glaze to drip off especially from the inside of the article, the glaze vessel is also substantially vertically movable in up and downward direction.

14 Claims, 3 Drawing Sheets

APPARATUS FOR AND METHOD OF GLAZING ARTICLES OF EARTHENWARE OR PROCELAIN

This is a continuation of application Ser. No. 07/800,623, filed Nov. 27, 1991 now abandoned.

BACKGROUND OF THE INVENTION

The present invention relates to an apparatus for glazing articles, in particular hollow containers such as bowls, pots, cans or the like, with at least one glazing station equipped with at least one glaze vessel which supports the article and is rotatable and swingable so as to allow the article to be at least partially immersed in a bath of glaze.

U.S. Pat. No. 4,995,331 describes a glazing apparatus of this type, which includes a capstan with a plurality of supporting arms, each of which being provided with a workpiece holder for at least one glaze vessel which securely holds the base of the article to be glazed by means of suction effect. The glaze vessel is actuated by suitable drive units to allow rotation thereof about its axis and tilting in direction of the glaze bath so as to at least partially immerse the article in glaze. The attachment of the glaze vessel to the workpiece holder and the supporting arm is such as to limit the tilting motion of the glaze vessel to an angular range of about 120°. Such a glazing apparatus works satisfactorily for glazing flat articles such as plates or the like; however, in connection with hollow articles of relatively great depth or bulged or bellied configuration, such as bowls, pots or the like, the prior art glazing apparatus is unsuitable for attaining an even wetting of the article and proper dripping off of excess glaze.

SUMMARY OF THE INVENTION

It is thus an object of the present invention to provide an improved glazing apparatus obviating the aforestated drawbacks.

In particular, it is an object of the present invention to provide an improved glazing apparatus by which hollow articles can be reliably and evenly glazed in fully automatic manner.

These objects and others which will become apparent hereinafter are attained in accordance with the present invention by providing the glazing apparatus with a drive unit by which the glaze vessel with the article to be glazed is not only rotatable about its own axis and tiltable toward the glaze bath but is also guided for displacement in a direction substantially vertical to the glaze bath level.

Through the provision of a drive unit for also allowing an essentially linear displacement of the glaze vessel in a vertical direction, hollow articles of relatively great depth and bellied configuration can reliably and evenly be glazed along the inside and outside surfaces. Suitably, the extent of vertical motion of the glaze vessel is made dependent on the depth of the article to be glazed and/or the particular configuration thereof.

According to another feature of the present invention, the glaze vessel is tiltable about an angular range of approximately 180° so that excess glaze can run off and drip back into the glaze bath, especially during vertical up and downward motion when the article is removed from the glaze bath.

Preferably, the glaze vessel with the article to be glazed is swung from an initial position to a point of immersion in the glaze bath until reaching a position tilted by 180°. In this manner the angular range by which the glaze vessel can be swung is considerably expanded. By providing three distinct displacement modes (rotational motion, titling motion, vertical motion), the movement or control of the glaze vessel may be selected in any suitable fashion. Advantageously, at least the speed and the extent of the upward and downward motion should be controllable.

According to another feature of the present invention, the rotational motion of the glaze vessel about its axis and the tilting motion and/or the vertical upward and downward motion are synchronized with each other in dependence on particular characteristics of the article. In this manner, articles of irregular shape can be reliably glazed. In addition, it is preferred to allow separate control of the rotational motion of the glaze vessel about its axis and the tilting motion and/or the vertical upward and downward motion to attain a nearly universal control system for the mode of movement of the glaze vessel. According to another feature of the present invention, the drive unit for carrying out the vertical movement of the glaze vessel includes a substantially straight stationary slide bar and a carriage movable along the slide bar and operatively connected to the glaze vessel, with the carriage moving upwardly and downwardly in an essentially vertical direction. However, it is preferred to mount the glaze vessel to a workpiece holder which in turn is acted upon by the drive unit.

BRIEF DESCRIPTION OF A PREFERRED EMBODIMENT

The above and other objects, features and advantages of the present invention will now be described in more detail with reference to the following drawing in which.

DETAILED DESCRIPTION OF PREFERRED EMBODIMENTS

Figure 1:
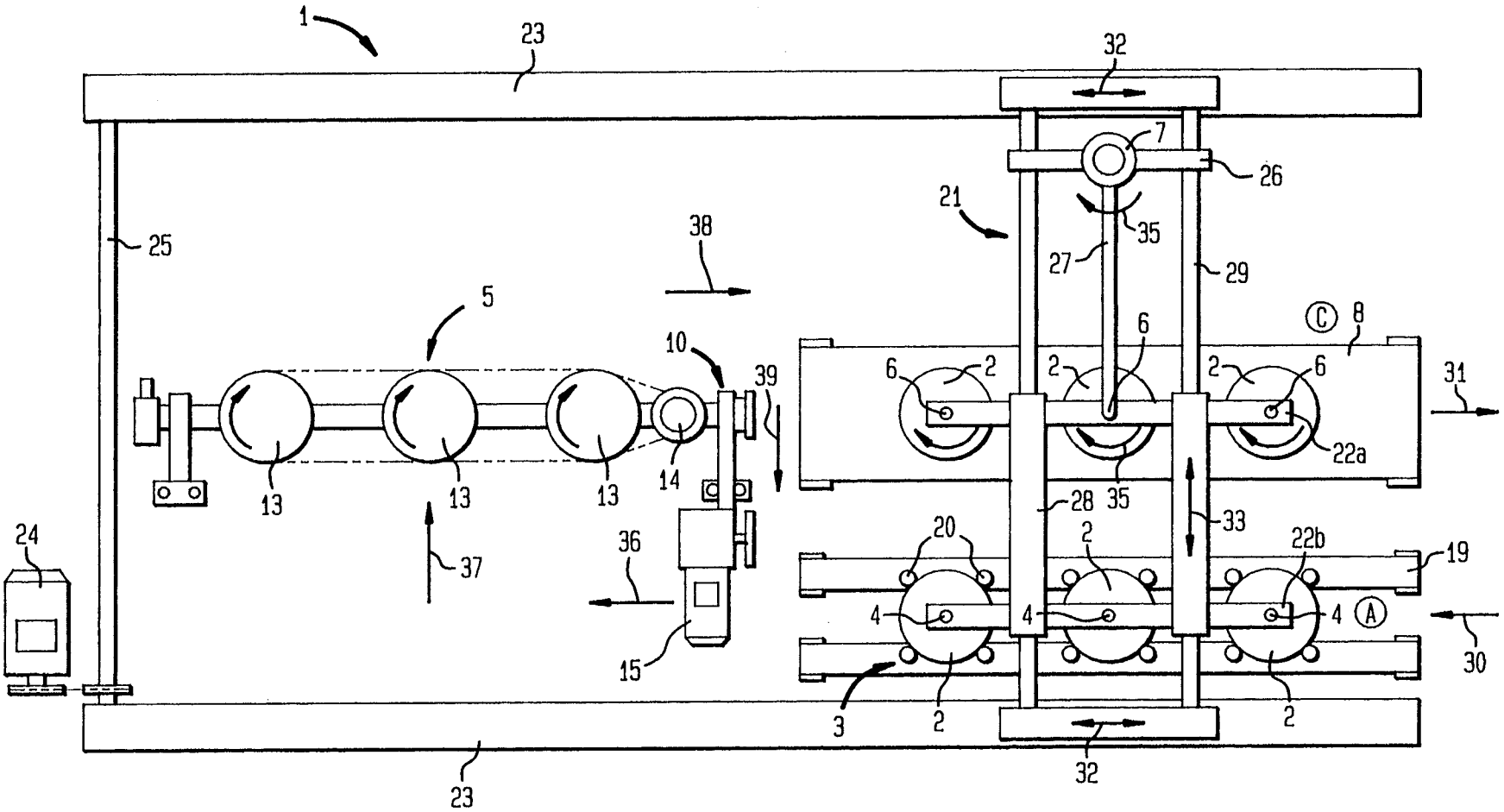
FIG. 1 is a schematic illustration of one embodiment of a glazing apparatus in accordance with the present invention.

Throughout all the Figures, the same or corresponding elements are always indicated by the same reference numerals.

Referring now to the drawing and in particular to FIG. 1, there is shown a schematic illustration of one embodiment of a glazing apparatus in accordance with the present invention for glazing hollow articles, such as pots, bowls or the like, made of e.g. earthenware or porcelain and generally designated by reference numeral 1. In the non-limiting example of FIG. 1, the glazing apparatus is designed for simultaneous glazing of three articles 2 which are transported by a conveyer 19 in direction of arrow 30 to a feed area A which includes a centering station, generally designated by reference numeral 3. The conveyor 19 is of a type having two belts spaced from each other so as to define an open intermediate space therebetween for allowing e.g. imprinting of suitable data to the external surface of the base of each article 2.

In the centering station 3, the articles 2 are properly aligned for subsequent treatment by respective sets of four rollers 20. After being aligned or centered, the articles 2 are grasped and picked up by a complementary set of three suction members 4 by which the articles 2 are simultaneously transferred and placed upon a complementary set of glaze pots or vessels 13 within a glazing station which is generally designated by reference numeral 5 and shown in more detail in FIG. 2.

After being glazed in the glazing station 5, the articles 2 are transferred from the glaze vessels 13 to an absorbent conveyor belt 8, situated in a discharge area C, by a complementary set of three suction members 6 before being advanced for further treatment as indicated by arrow 31. The suction members 6 are rotatable to spin the articles 2 when being placed upon the absorbent belt 8 so as to remove excess glaze from the footing or bottom of the glazed article.

In this context, reference is also made to U.S. Pat. No. 4,995,331, which generally describes an exemplified glazing apparatus of the type herein disclosed. As illustrated in FIG. 1, the set of suction members 4 and the set of suction members 6 are suitably coupled with each other via a carriage which is generally designated by reference numeral 21 and attached to the suction members 4 and suction members 6 via support bars **22*a*, 22*b* so as to allow simultaneous displacement of the suction members 4 and suction member 6. The carriage 21 runs in spaced parallel guide rails 23 and is driven by a motor 24 for displacement in direction of double arrow 32. The motor 24 is operatively connected to a crossbar 25 which extends between the guide rails 23. A second motor 7 is suitably connected to the carriage 21 via a cross bar 26 and is linked to the support bar 22*a* by a connecting rod 27 to allow displacement of the carriage 21 in direction of double arrow 33 via suitable pneumatic cylinders 28 and guide rails 29. Thus, the suction members 4 and the suction members 6 are shiftable in unison by the motors 22 and 7** in the horizontal along the X-coordinate and Y-coordinate.

Figure 2:
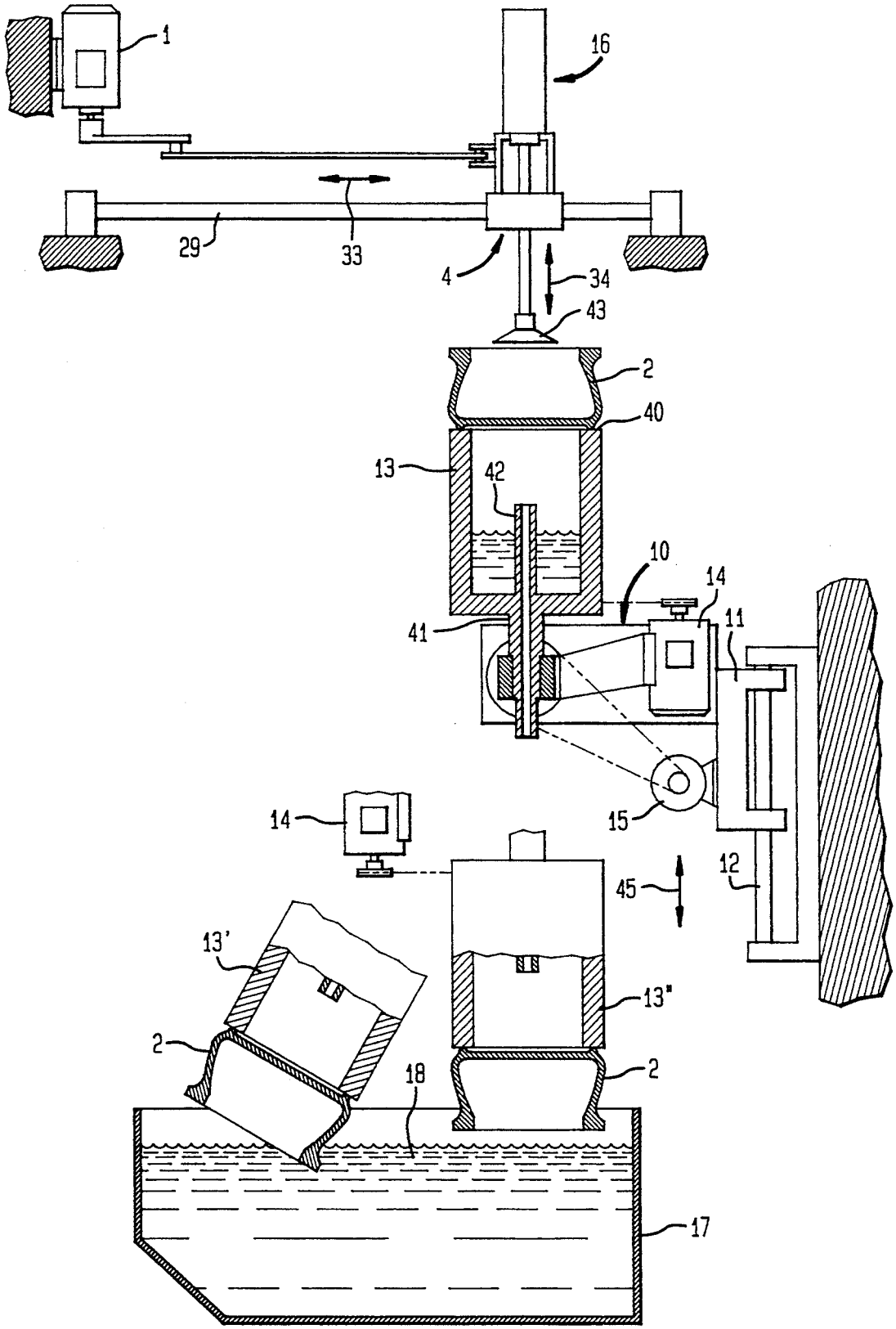
FIG. 2 is a side view of a glazing station in accordance with the present invention, illustrating in detail various positions of a glaze vessel during the glazing process.
Figure 3:
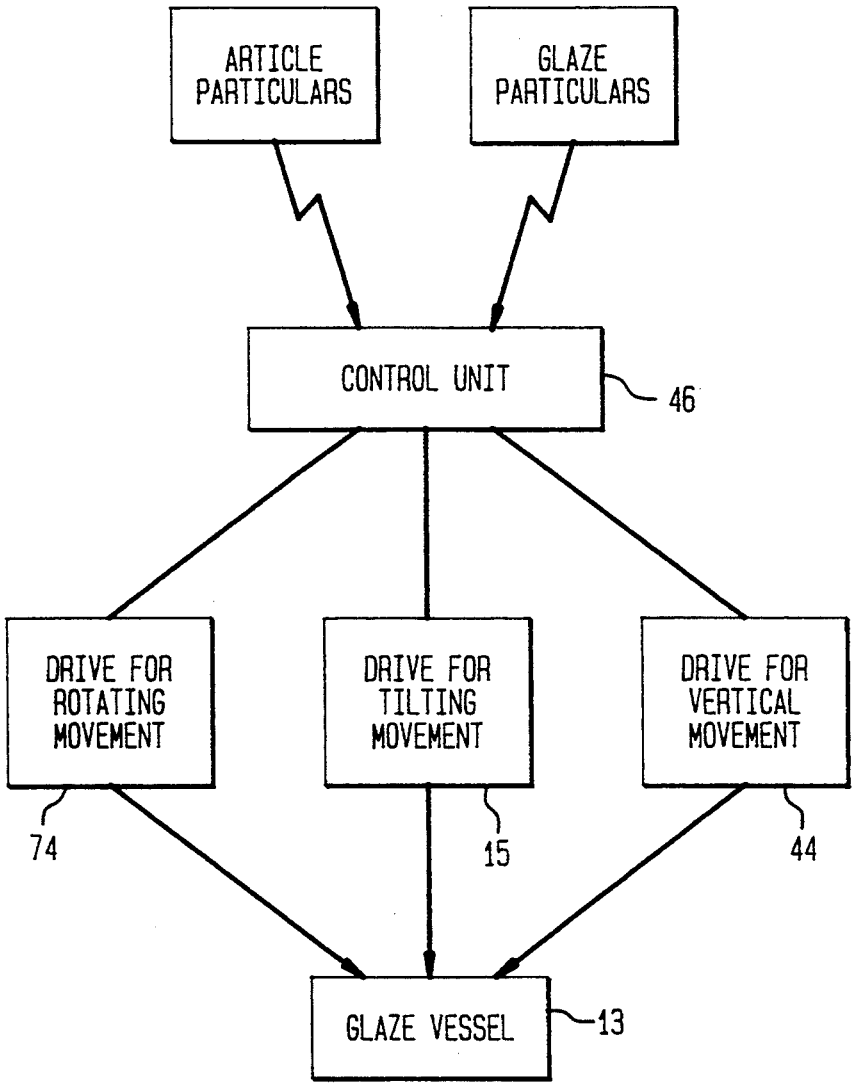
FIG. 3 is a schematic block diagram showing various parts of the present invention.

Turning now to FIG. 2, which shows a side view of a preferred embodiment of a glazing station 5 according to the present invention, it can be seen that the glazing station 5 of the glazing apparatus 1 includes a workpiece holder, generally designated by reference numeral 10 by which the article 2 to be treated is retained during its passage through the various stages of the glazing apparatus 1. Each workpiece holder 10 supports one glaze vessel 13 and is mounted to a carriage 11. As indicated by the double arrow 45, the carriage 11 is upwardly and downwardly movable in essentially vertical direction along a slide bar 12 by means of a suitable drive 44 (FIG. 3) e.g. a pneumatic cylinder/piston arrangement (not shown). The workpiece holder 10 is operatively connected to a speed controllable motor 14 by which the workpiece holder 10 and thus the glaze vessel 13 with the article 2 is rotatable about its axis. In order to allow a tilting motion of the glaze vessel 13, the workpiece holder 10 is further acted upon by a controllable motor 15 by which the glaze vessel 13 can be swung about an angle of about 180°.

Each glaze vessel 13 is essentially of hollow cylindrical configuration to define an interior in which a specific amount of glaze is contained to allow also glazing of the base of the article 2. At its upper side, the glaze vessel 13 may be provided with an annular elastic receiving surface 40 for allowing soft support of the article. The elasticity of the receiving surface 40 can be attained by suitable material selection or suitable design.

At its lower end, each glaze vessel 13 is provided with a central projection 41 by which the glaze vessel 13 is supported in the workpiece holder 10. The projection 41 has a central channel which is prolonged into the interior of the glaze vessel 13 by a suction pipe 42 which is suitably connected to an aspirator (not shown) so as to generate an underpressure in the interior of the glaze vessel 13. By means of the underpressure, the article 2 placed on the receiving surface 40 of the glaze vessel 13 is securely held in position.

Each suction member 4, 6 (only suction member 4 is shown in FIG. 2) is provided at its end facing the article 2 with a suction cup 43. Reference numeral 16 schematically designates a suitable drive assembly to move the suction member 4 in vertical direction as indicated by double arrow 34. Thus, the suction members 4 can be shifted in the horizontal in direction of arrows 32, 33 and in the vertical as indicated by arrow 34 in order to pick up the articles 2 and suitably place them upon the glaze vessels 13 in the glazing station 5.

Although not shown in detail, the suction members 6 are actuated upon in like manner by a drive assembly which, however, in addition to a vertical displacement, provide a rotation of the suction members about their axis as indicated by arrow 35 (FIG. 1) in order to allow removal of excess glaze about the footing or base of the article 2 when placed upon the absorbent belt 8.

In the position of the glazing apparatus 1 as shown in FIG. 1, the carriage 21 is positioned such that the set of suction members 4 is ready to pick up raw articles 2 from the conveyor belt 19 while the suction members 6 place glazed article 2 upon the absorbent belt 8. The carriage 21 is then moved to the left as indicated by arrow 36 to allow suction members 6 to pick up glazed articles 2 from the glaze vessels 13, and shifted horizontally in direction of arrow 37 until the suction members 4 are now aligned with the glaze vessels 13. The suction members 4 are lowered to place the raw articles 2 on the glaze vessels 13. Subsequently, the carriage 21 is moved to the right as indicated by arrow 38 and returned to its initial position in direction of arrow 39 in which the suction members 4 pick up further raw articles 2 while the suction members 6 place the glazed articles 2 upon the absorbent belt 8. Thus, the glazing apparatus 1 essentially carries out a four-cycle process.

Turning now again to FIG. 2, the steps for glazing the articles 2 in the glazing station 5 are described. It will be appreciated that the following description of individual glazing steps is done by way of example only.

After the raw articles 2 are placed on the respective glaze vessels 13 by the suction members 4, each glaze vessel 13 is swung until the article 2 dips in the glazing mass within glaze trough 17 as indicated in broken lines by the glaze vessel 13' on the lower left hand side. While simultaneously being rotated to attain an even glazing of the inside surface and outside surface, the glaze vessel 13 is further tilted until being swung by about 180°. In this position, the article 2 is completely submerged within the glaze bath. The depth of immersion of the article 2 in the glaze trough 17 and thus the motion of the carriage 11 is selected such that the article 2 is essentially fully and evenly wetted with glazing mass. At the same time, the speed of rotation of the glaze vessel 13 about its axis as well as the tilting speed and/or tilting angle can be controlled and regulated separately or in combination.

After glazing the article 2, the glaze vessel 13 is positioned as indicated in broken lines by the glaze vessel 13" on the lower right hand side in which the article 2 extends slightly above the level 18 of the glazing mass within the trough 17. In this position, i.e. outside the glaze bath, the glaze vessel 13 is moved up and down in vertical direction via the workpiece holder 10 to allow excess glaze to run or drip off the article 2 and back to the glaze trough 17. Thereafter, the glaze vessel 13 is returned to its initial position for allowing the glazed articles 2 to be grasped and picked up by the suction members 6 for transfer to the absorbent belt 8 in the discharge area C.

Since the glaze vessels 13 are controllable in direction of three distinct modes of movement, the glazing process can be carried out in any suitable fashion, and thus should not be limited to the sequence as set forth above. However, in order to attain a removal of excess glaze, the up and down movement of the glaze vessel 13 should be done with the article 2 being removed from the glaze bath, i.e. extending above the level 18 of the glaze bath.

Persons skilled in the art will understand that the number of suction members 4 and 6 may certainly vary from the example as shown in FIG. 1. Also, it is possible to provide successive rows of three suction members 4 and 6. The provision of at least two suction members 4 and 6 per row is, however, preferred. In dependence on the desired output of the glazing apparatus 1, a circular table arrangement similar to the glazing apparatus according to U.S. Pat. No. 4,995,331 may also be selected. In this case, the glazing station should be modified to allow the appropriate movements of the glaze vessel 13.

It will also be appreciated that the individual movements of the glaze vessel 13 may be separately controlled or also controlled in unison by a suitable control unit 46 (FIG. 3) by which the displacement of the glaze vessel 13 is specifically selectable and adjustable depending on the particular article. Also, the control unit 46 for the glaze vessel may be so modified as to take into account certain properties of the applied glazing mass, such as viscosity or the like.

It should be further noted that a universal drive may be used for swinging the glaze vessel by at least 180° and/or for moving the glaze vessel 13 essentially vertical to the glaze level 18 in the glaze trough 17.

While the invention has been illustrated and described as embodied in an apparatus for glazing an article of earthenware or porcelain, it is not intended to be limited to the details shown since various modifications and structural changes may be made without departing in any way from the spirit of the present invention.

What is claimed as new and desired to be protected by Letters Patent is set forth in the appended claims:

I claim:

1. A method for glazing a hollow article of earthenware or porcelain, comprising the steps of:

placing the article in an upright position with an opening facing vertically upwards on a glaze vessel and positioning the vessel above a trough containing a glazing mass;

tilting the glaze vessel from the upright position to an intermediate slanted position for sufficiently immersing the article in the glazing mass and rotating the article at the same time in order to effect a glazing of the article;

removing excess glazing mass contained in the hollow article by further tilting the glaze vessel to an inversed position in which the article emerges from the glazing mass and by subsequently rotating the article about its axis and moving the article in the inversed position in a vertical direction relative to the glazing mass to force excess glazing mass within the hollow article to drip off and to return to the glazing mass; and returning the glaze vessel to the initial upright position.

2. A method as defined in claim 1 wherein said moving step includes guiding the article upwardly and downwardly in vertical direction when the article is positioned above the glazing mass.

3. A method as defined in claim 1 wherein said tilting step includes swinging the glaze vessel from the upright position to the intermediate slanted position about an angle of less than 180°.

4. A method as defined in claim 1, further comprising controlling the speed of movement of the glaze vessel in vertical direction.

5. A method as defined in claim 1, further comprising selectively and separately controlling said rotating, tilting and moving steps.

6. Apparatus for glazing a hollow article of bellied configuration, comprising:

glazing means for glazing the article, said glazing means including a glaze bath and a glaze vessel with a receiving surface for supporting the article; and drive means operatively connected to said glaze vessel for controlling movement of said glaze vessel to attain an even and complete glazing of the article, said drive means including a first drive unit for swinging said glaze vessel in direction of said glaze bath from an initial upright position to an intermediate slanted position in which the article is at least partly immersed in said glaze bath and subsequently to an inversed position in which the article emerges from the glaze bath, a second drive unit for turning said glaze vessel about its axis to rotate the article when the glaze vessel is in the slanted and inversed position, and a third drive unit for moving said glaze vessel in a vertical direction relative to said glaze bath when the glaze vessel is in the inversed position to allow excess glaze to drip off and to return to said glaze bath.

7. Apparatus as defined in claim 6 wherein said third drive unit moves said glaze vessel linearly upwardly and downwardly.

8. Apparatus as defined in claim 6 wherein said third drive unit moves said glaze vessel upwardly and downwardly in vertical direction.

9. Apparatus as defined in claim 6 wherein said drive means includes a control unit for cooperation with at least said third drive unit for regulating the speed of the up and downward movement of said glaze vessel.

10. Apparatus as defined in claim 6 wherein said drive means includes a control unit for synchronizing said first, second and third drive units.

11. Apparatus as defined in claim 6 wherein said drive means includes a control unit for selectively and separately controlling said first, second and third drive units.

12. Apparatus as defined in claim 6 wherein said third drive unit includes a substantially straight stationary slide bar and a carriage moveable along said slide bar and operatively connected to said glaze vessel to effect an up and down movement of said glaze vessel in vertical direction.

13. Apparatus as defined in claim 12 wherein said third drive unit includes a substantially straight stationary slide bar and a carriage moveable along said slide bar and operatively connected to said workpiece holder to effect the up and down movement of said glaze vessel.

14. Apparatus as defined in claim 6, and further comprising a workpiece holder mounted to said glaze vessel, said drive means being operatively connected to said workpiece holder for actuation of said glaze vessel.

* * * * *